US012480736B2

(12) United States Patent
Weiland

(10) Patent No.: US 12,480,736 B2
(45) Date of Patent: Nov. 25, 2025

(54) PNEUMATIC RIFLE FOR ALTERNATIVE AMMUNITION

(71) Applicant: Christopher J. Weiland, Fredericksburg, VA (US)

(72) Inventor: Christopher J. Weiland, Fredericksburg, VA (US)

(73) Assignee: United States of America, as represented by the Secretary of the Navy, Arlington, VA (US)

( * ) Notice: Subject to any disclaimer, the term of this patent is extended or adjusted under 35 U.S.C. 154(b) by 25 days.

(21) Appl. No.: 18/590,043

(22) Filed: Feb. 28, 2024

(65) Prior Publication Data

US 2025/0271235 A1 Aug. 28, 2025

(51) Int. Cl.
*F41B 11/50* (2013.01)
*F41B 11/64* (2013.01)

(52) U.S. Cl.
CPC ..... *F41B 11/50* (2013.01); *F41B 11/64* (2013.01)

(58) Field of Classification Search
CPC ..... F41B 11/50; F41B 11/64; F41B 11/72; F41B 11/721; F41B 11/722; F41B 11/723
See application file for complete search history.

(56) References Cited

U.S. PATENT DOCUMENTS 5,613,483 A * 3/1997 Lukas ..... F41B 11/724 124/75
7,735,479 B1 * 6/2010 Quinn ..... F41B 11/723 124/75
9,752,846 B1 * 9/2017 Kenaley ..... F41B 11/71
2007/0039601 A1 * 2/2007 Jong ..... F41B 11/62 124/73
2007/0113836 A1 * 5/2007 Dobbins ..... F41B 11/62 124/73
2007/0163562 A1 * 7/2007 Gan ..... F41B 11/721 124/73
2007/0227519 A1 * 10/2007 Wood ..... F41B 11/68 124/73
2008/0127960 A1 * 6/2008 Gan ..... F41B 11/721 124/75
2008/0135031 A1 * 6/2008 Gan ..... F41B 11/721 124/75
2008/0264399 A1 * 10/2008 Dobbins ..... F41B 11/721 124/71

(Continued)

FOREIGN PATENT DOCUMENTS

WO WO-9900635 A1 * 1/1999 ..... F41B 11/52
WO WO-2008097265 A2 * 8/2008 ..... F41B 11/723

*Primary Examiner* — Jonathan C Weber
(74) *Attorney, Agent, or Firm* — Gerhard W. Thielman

(57) ABSTRACT

A hand-held gun for interchangeably propel a round of one of solid and liquid consistency is provided. The gun includes a gas actuator, a firing module, a magazine, a loader and a barrel. The gas actuator stores and releases compressed gas. The firing module includes a chamber for receiving the gas to push forward a bolt in response to actuation by a trigger. The module is disposed forward of the actuator. The magazine contains ammunition that constitutes the round. The loader laterally receives the round from the magazine and longitudinally receiving the bolt to eject the round. The loader is disposed forward of the module. The barrel directs the round ejected from the loader, and is disposed forward of the loader.

8 Claims, 7 Drawing Sheets

(56) References Cited

U.S. PATENT DOCUMENTS

| | | | | |
|---|---|---|---|---|
| 2009/0064981 | A1* | 3/2009 | Dobbins | F41B 11/62 124/75 |
| 2009/0133682 | A1* | 5/2009 | Dobbins | F41B 11/721 124/73 |
| 2009/0178661 | A1* | 7/2009 | Wood | F41B 11/68 124/73 |
| 2010/0083944 | A1* | 4/2010 | Dobbins | F41B 11/71 200/310 |
| 2010/0108049 | A1* | 5/2010 | Dobbins | F41B 11/721 124/73 |
| 2011/0088675 | A1* | 4/2011 | Wood | F41B 11/721 124/73 |
| 2011/0114072 | A1* | 5/2011 | Halmone | F41B 11/721 124/71 |
| 2012/0090586 | A1* | 4/2012 | Wood | F41B 11/721 124/73 |
| 2012/0227725 | A1* | 9/2012 | Dobbins | F41B 11/62 124/75 |
| 2012/0285435 | A1* | 11/2012 | Dobbins | F41A 19/12 124/77 |
| 2014/0202441 | A1* | 7/2014 | Dobbins | F41B 11/62 420/71 |
| 2018/0106575 | A1* | 4/2018 | Dobbins | F41B 11/70 |
| 2018/0142984 | A1* | 5/2018 | Harvey | F41B 11/62 |
| 2019/0107360 | A1* | 4/2019 | Dobbins | F41B 11/62 |
| 2022/0299292 | A1* | 9/2022 | Dobbins | F41B 11/70 |

* cited by examiner

PNEUMATIC RIFLE FOR ALTERNATIVE AMMUNITION

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to pneumatic or other gas-powered guns. In particular, the invention relates to a hand-held long-barrel firearm that dispenses either non-lethal solid rounds or liquid slugs depending on the selected magazine being attached for loading ammunition.

SUMMARY

Conventional gas powered rifles yield disadvantages addressed by various exemplary embodiments of the present invention. In particular, various exemplary embodiments provide a hand-held gun for interchangeably propel a round of one of solid and liquid consistency. The gun includes a gas actuator, a firing module, a magazine, a loader and a barrel. The gas actuator stores and releases compressed gas.

The firing module includes a chamber for receiving the gas to push forward a bolt in response to actuation by a trigger. The module is disposed forward of the actuator. The magazine contains ammunition that constitutes the round, whether solid round or liquid slug. The loader laterally receives the round from the magazine and longitudinally receiving the bolt to eject the round. The loader is disposed forward of the module. The barrel directs the round ejected from the loader, and is disposed forward of the loader.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

The disclosure generally employs quantity units with the following abbreviations: length in meters (m) or inches ("), mass in grams (g) or pounds-mass (lbm), time in seconds(s), angles in degrees (°), force in newtons (N), pressures in pascals (Pa) or pounds-per-square-inch-gage (psig), temperature in kelvins (K), and energy in joules (J). Supplemental measures can be derived from these, such as density in grams-per-cubic-centimeters ($g/cm^3$), moment of inertia in kilogram-square-meters ($kg\text{-}m^2$) and the like.

The exemplary small Universal Dispersing System (sUDS) rifle uses gas pressure to interchangeably propel either a solid round or a finite quantity of liquid consistency, depending on the magazine attached. The sUDS rifle employs an electric switch to activate the gas release in response to pressing a trigger.

The intent of exemplary embodiments is to foster a non-lethal and/or a counter small Unmanned Aerial System (sUAS) weapon. In its present configuration, the system is designed as a rifle. However future disclosures expect modification of the single barrel rifle configuration into a multi-barrel turret.

Figure 1:
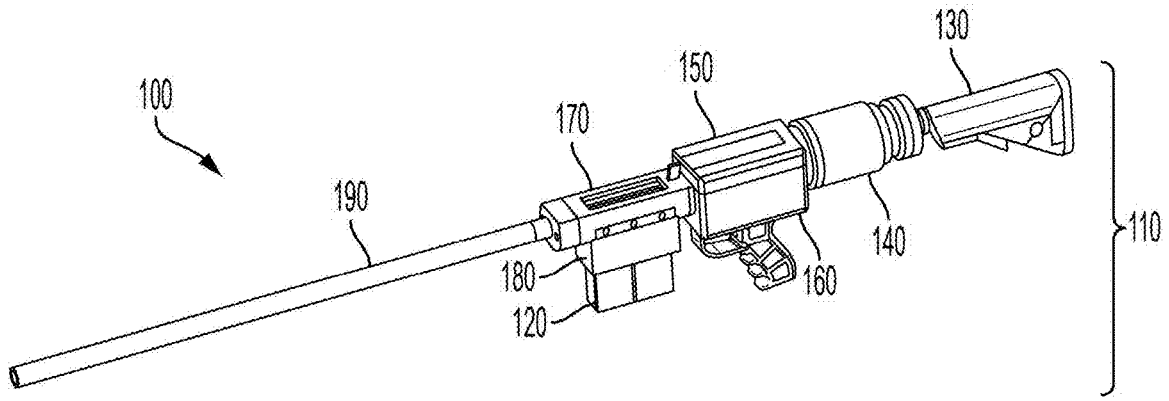
FIG. 1 is a perspective assembly view of a first embodiment of an exemplary pneumatic rifle.

FIG. 1 shows a perspective view 100 of a first configuration of an assembly 110 of the exemplary sUDS rifle. The assembly 110 includes an ammunition magazine 120, a butt stock 130, a gas actuator 140, an upper grip cover 150, a lower assembly 160, an upper box receiver 170, a lower box receiver 180 and a barrel 190. The upper receiver 170 includes a top protective cover. The barrel 190 is presumed to include a rifled bore to provide axial spin to the projectile to be ejected. However, the disclosure conceptually includes a smooth-bore long-gun.

Figure 2A:
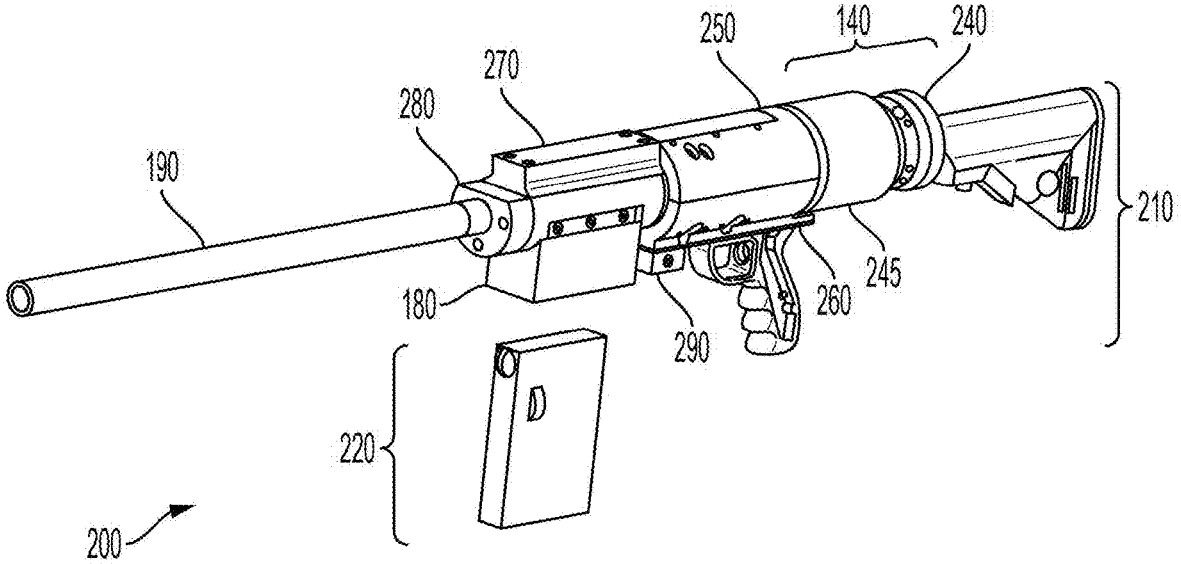
FIGS. 2A and 2B are perspective assembly views of a second embodiment of an example pneumatic rifle in a first configuration.
Figure 2B:
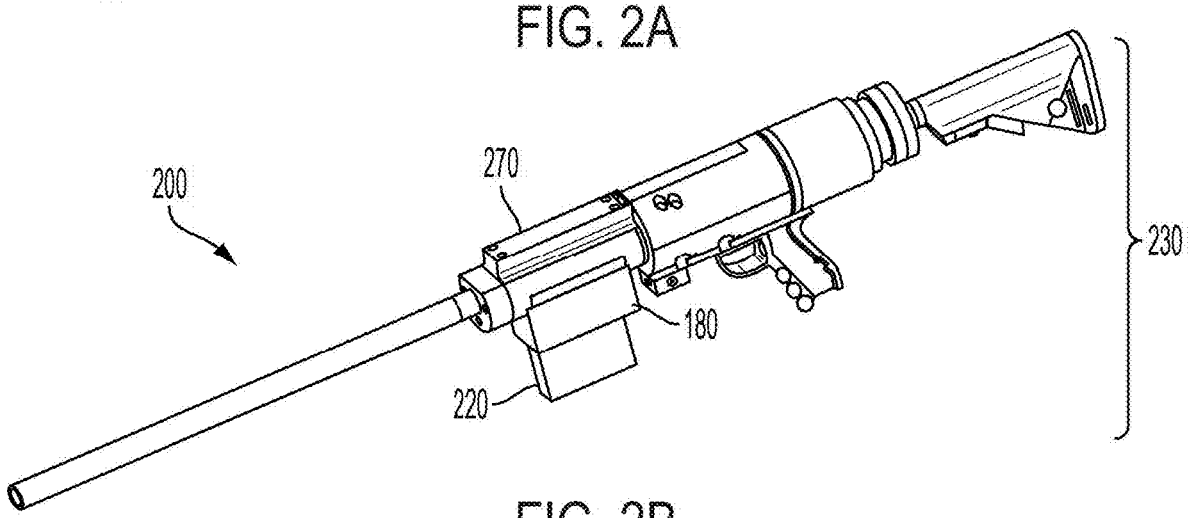

FIG. 2 shows a perspective view 200 of a second configuration of an assembly 210 of the exemplary sUDS rifle. The assembly 210 includes a magazine 220 that combines with the assembly 210 as a loaded sUDS rifle 230. The actuator 140 comprises an annular compressed air container 240 and an air reservoir 245. The container 240 can store air or an alternative compressed gas. The assembly 210 further includes the actuator 140, an upper half-cylinder 250, a lower half-cylinder 260, a receiver 270, a flange connector 280 and an air manifold 290. The lower half-cylinder 260 includes a handle. The receiver 270 includes a protective top cover. The barrel 190 extends forward from the flange connector 280.

Figure 3:
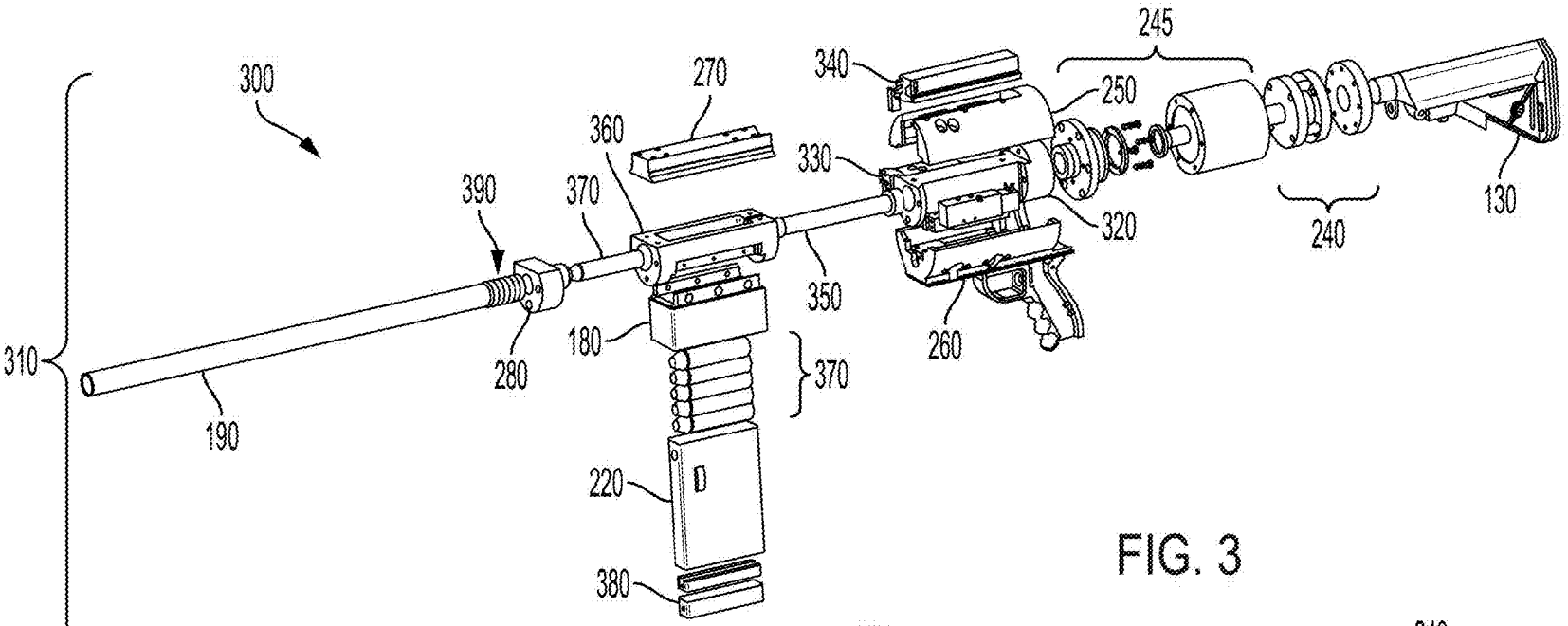
FIG. 3 is a perspective exploded view of the second embodiment.

FIG. 3 shows a perspective exploded view of the second configuration of components 310 for the loaded sUDS rifle 230. The components include a bolt carrier 320, a cradle 330, an air loader 340 (for cycling), a serrated hollow bolt 350, a loader 360, solid ammunition rounds 370, a magazine lid 380 and outer threads 390 on the barrel 190.

The length of the rifle 110, 230 approximates that of a Remington 870 shotgun, roughly 36 inches long, depending on the barrel 190. The bore can be ¾" diameter, although alternate sizes can be incorporated, corresponding with the diameter of the bolt 350. The rifle's total weight is about ten pounds-mass.

Figure 5:
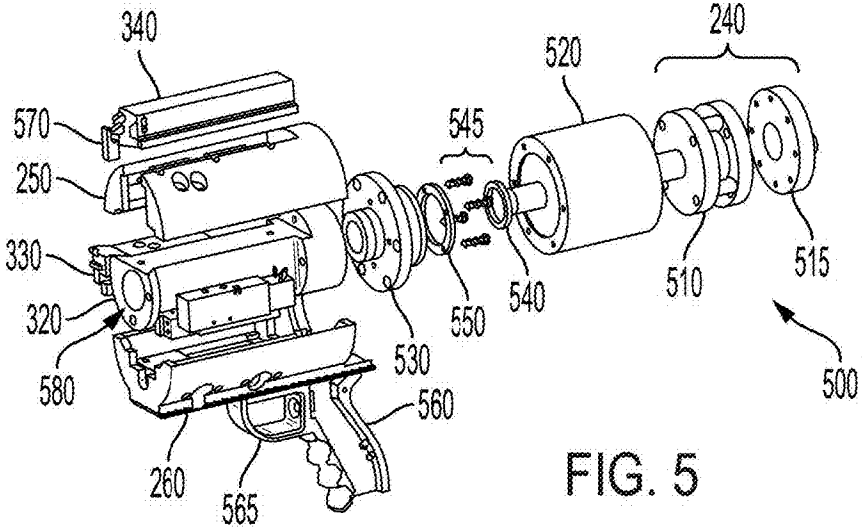
FIG. 5 is a perspective exploded view of the aft mid-section.
Figure 4:
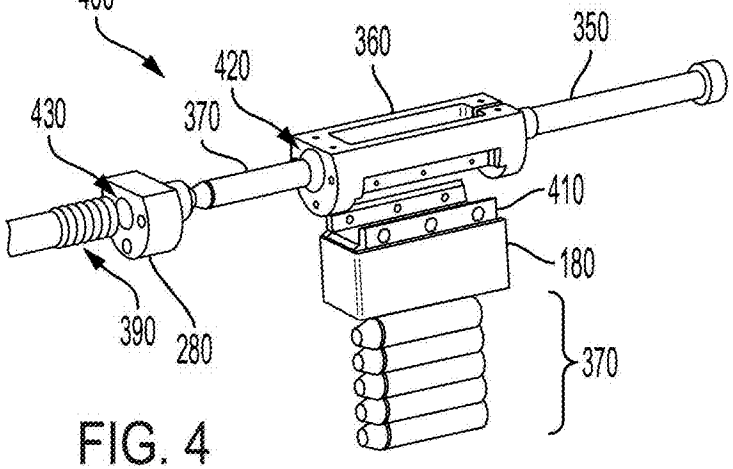
FIG. 4 is a perspective exploded view of the forward mid-section.

FIG. 4 shows an exploded detail perspective view 400 of components 310 adjacent the magazine 180, which includes a lip 410, the loader 360 with a chamber 420, and the flange 280 with a through-hole 430 designed to receive threads 390. FIG. 5 shows an exploded detail perspective of aft mid-section behind the magazine 180. This includes a manifold 510 with an end flange 515, an annular sleeve 520, a fore flange 530, a cylinder plug 540, bolts 545, a ring 550, a handle 560 with trigger guard 565, a tab 570 extending from the bolt 350, a through-hole cavity 580 of the bolt carrier 320. The air container 240 comprises the manifold 510 and flange 515. The air reservoir 245 comprises the sleeve 520, flange 530 and internal components contained therein.

Figure 6:
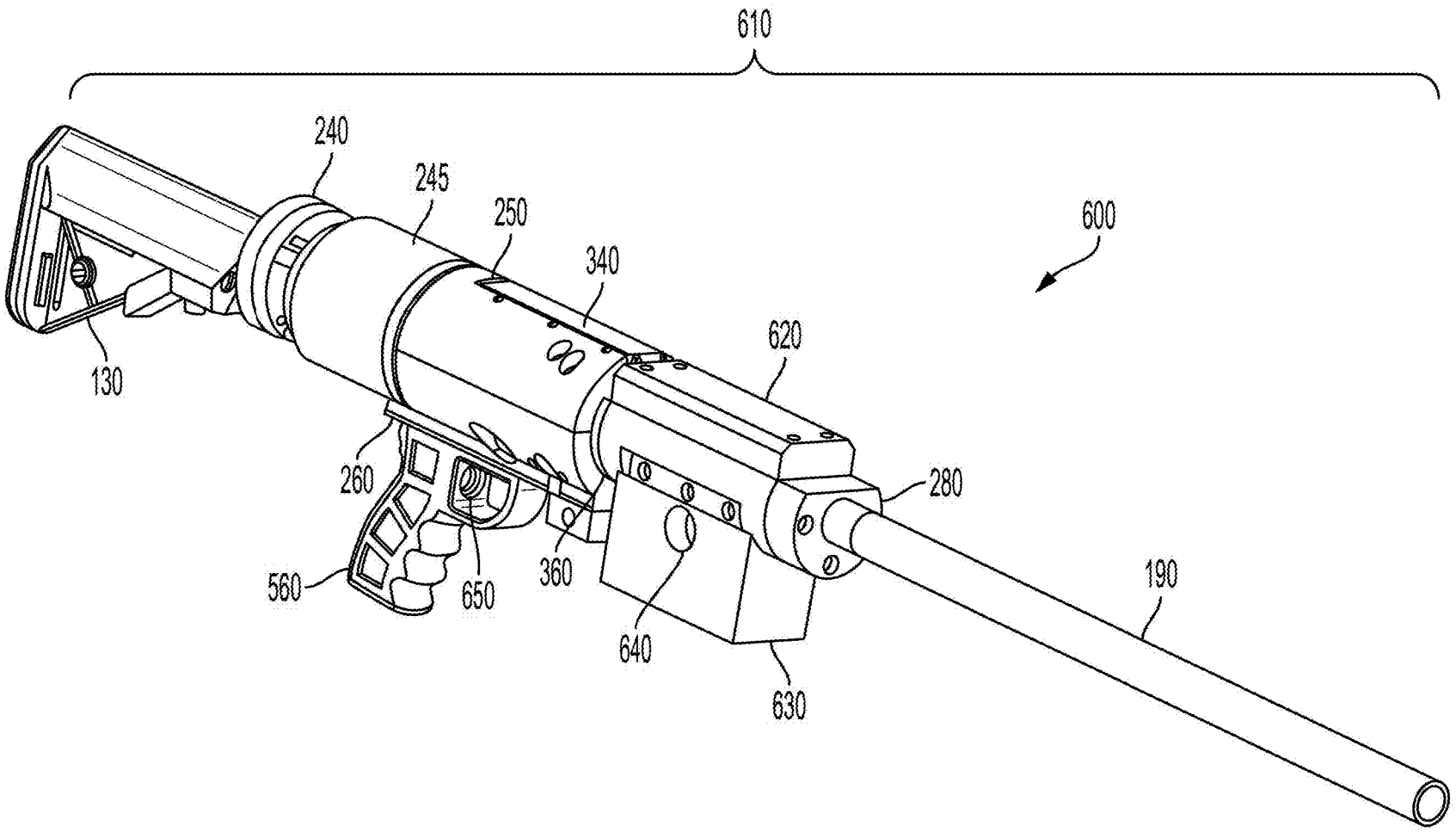
FIG. 6 is a perspective assembly view of the second embodiment in a second configuration.

FIG. 6 shows a perspective view 600 of an assembly 610 the sUDS rifle 230 in the liquid firing configuration. A receiver 620 receives a detachable magazine 630 containing liquid for ammunition that can be refilled via a fluid inlet 640 as a lateral orifice. A flexible conduit (not shown) can connect to the inlet 640 to continually fill the magazine 630. A trigger 650 within the handle 560 behind the guard 565 enables release of the metered liquid ammunition by gas ejection.

The only difference between rifle 110 and rifle 230 is the receiver 170 & 180, 270 & 280 and the magazine 220, 630, depending on whether ammunition is solid or liquid. The operating pressure, length, bore, mass do not vary between these rifles 110, 230. Chamber pressure ranges between 100 psig and 300 psig, with muzzle exit velocity depending on that pressure. Higher chamber pressures enable increased range, but also increase the probability of lethality.

Figure 7A:
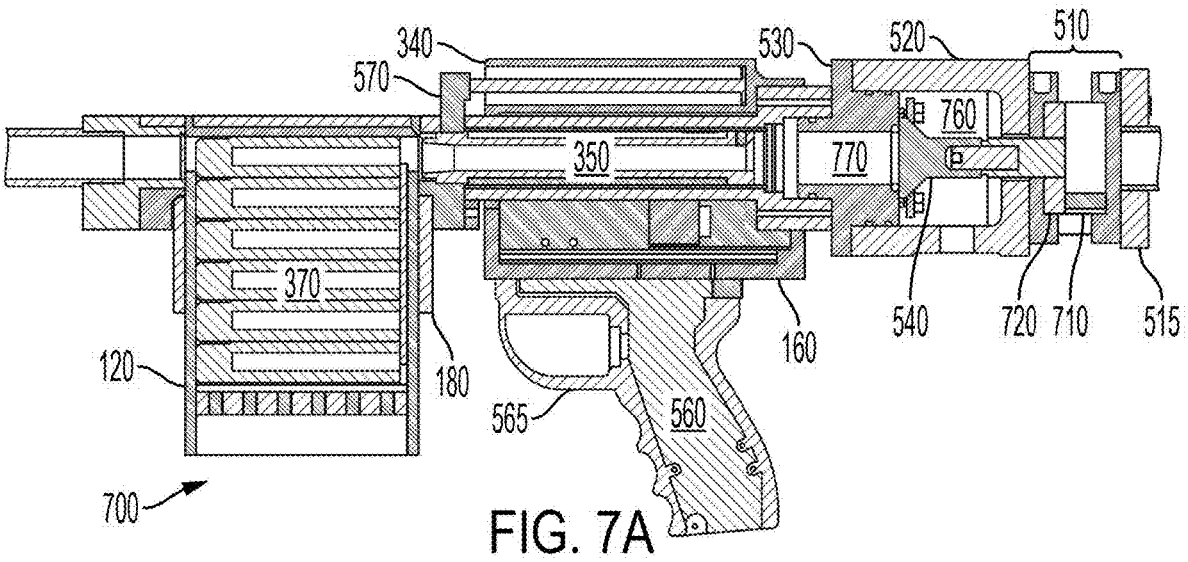
FIGS. 7A, 7B and 7C are elevation cross-section views of the first embodiment.
Figure 7B:
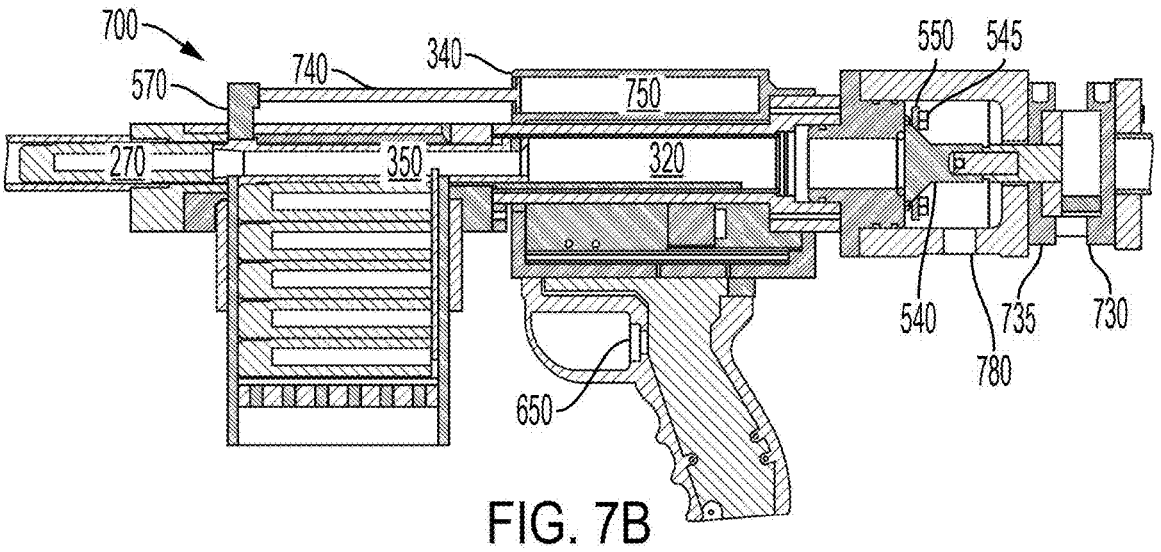
Figure 7C:
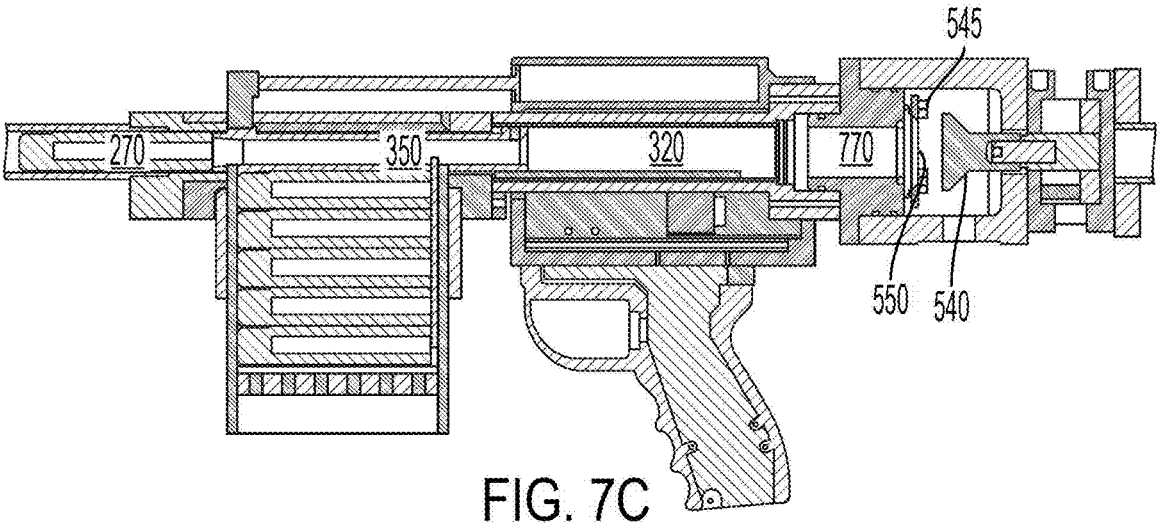

FIGS. 7A, 7B and 7C show detail cross-section elevation views of the sUDS rifle assembly 110 in the first configuration. A cylindrical annulus 710 enables a piston 720 to move aft. Aft and fore blocks 730 and 735 axially flank the cylinder 710 to bound the manifold 510 between the flange 515 and the sleeve 520. As the bolt 350 pushes an ammunition round 270 forward from FIGS. 7A to 7B, the tab 570 pulls along a slide rod 740 from the aft end of the upper half-cylinder 250 to its fore end, thereby providing a cavity within an air cylinder 750 in the air loader 340.

The sleeve 520 provides a high-pressure gas charge volume 760, and the flange 530 provides an axial cylindrical gap 770. To reset pressurized gas transfer from FIGS. 7B to 7C, the plug 540 axially translates within the volume 760 as the piston 720 attached thereto slides within the cylinder 710. The ring 550 within the internal volume 760 and mounted to the flange 530 by bolts 545 provides a sealing surface that drives the round 370 along the barrel 190, while enabling the plug 540 to slide fore and aft to correspondingly close or open the passage between the volume 760 and the gap 770 that reaches the bolt carrier 320. Compressed gas migrates from the container 240 and the volume 760 within the sleeve 520 into the gap 770 in order to push the bolt 350 forward.

The ring 550 is screwed to the flange 530 to secure a rubber sealing gasket, thereby sealing the high pressure gas charge volume 760. The ring 550 forms a gasket under compression. The manifold 510 constitutes a commercial self-contained airtight unit used in industrial applications. Bolting the manifold 510 to the sleeve 520 compresses an o-ring at the interface between the sleeve 520 and the manifold 510. The o-ring inhibits gas leakage out from the sleeve 520. The container 240 is a threaded non-pressurized item that enables a stock to thread to the rifle 110, 230.

The bolt 350 is not actuated by gas pressure via the ring 550. Instead, the bolt 350 is actuated using the air loader 340 and tab 570. The bolt 350 is hollow, enabling gasses to flow therethrough from volume 760 through gap 770 to drive a solid or liquid projectile. The air loader 340 has substantially similar function to manifold 510, albeit having distinctive purposes and sizes.

Figure 8A:
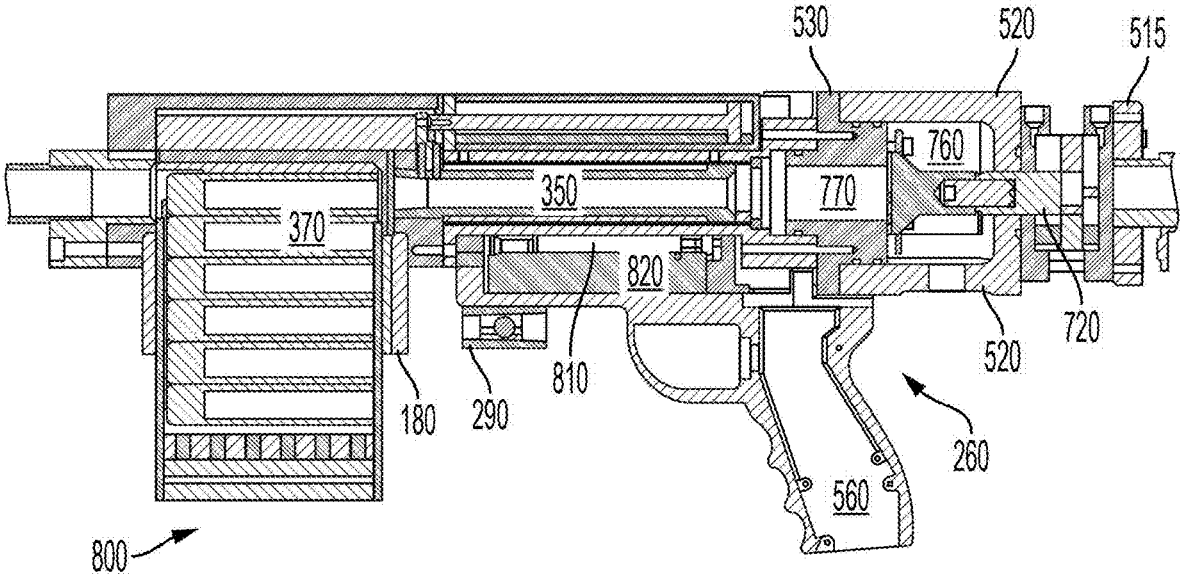
FIGS. 8A and 8B are elevation cross-section views of the second embodiment in the first configuration.
Figure 8B:
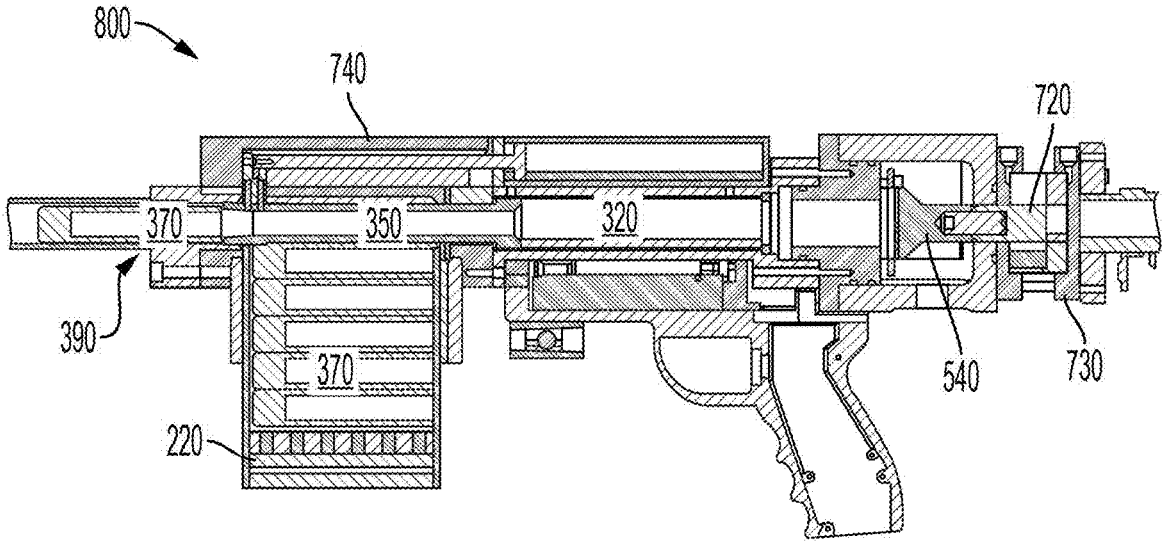

FIGS. 8A and 8B show detail cross-section elevation views of the sUDS rifle assembly 230 in the second configuration for solid rounds 370. After a round 370 feeds into the chamber 420 from the magazine 220, the bolt 350 slides forward pushing the round 370 into the barrel 190. A solenoid 810 operates inside a space 820 within the lower half-cylinder 260. The space 820 is located within the hand grip 560. It has a geometrically compensating purpose, as the rifle 110, 230 doesn't quite align with an operator's eye when being shouldered absent the increased height of the handle 560, which produces the gap 820.

Figure 9A:
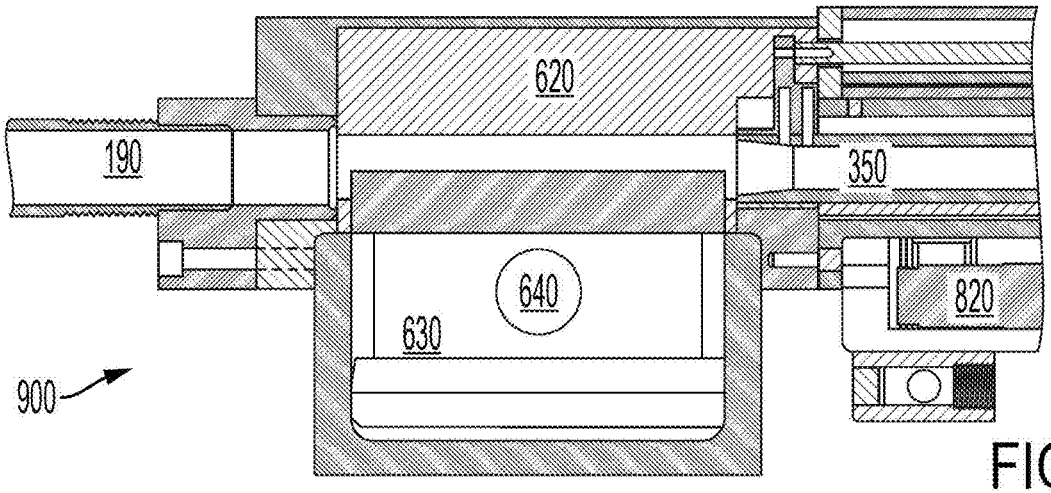
FIGS. 9A, 9B and 9C are detail cross-sectional elevation views of the second embodiment in the second configuration.
Figure 9B:
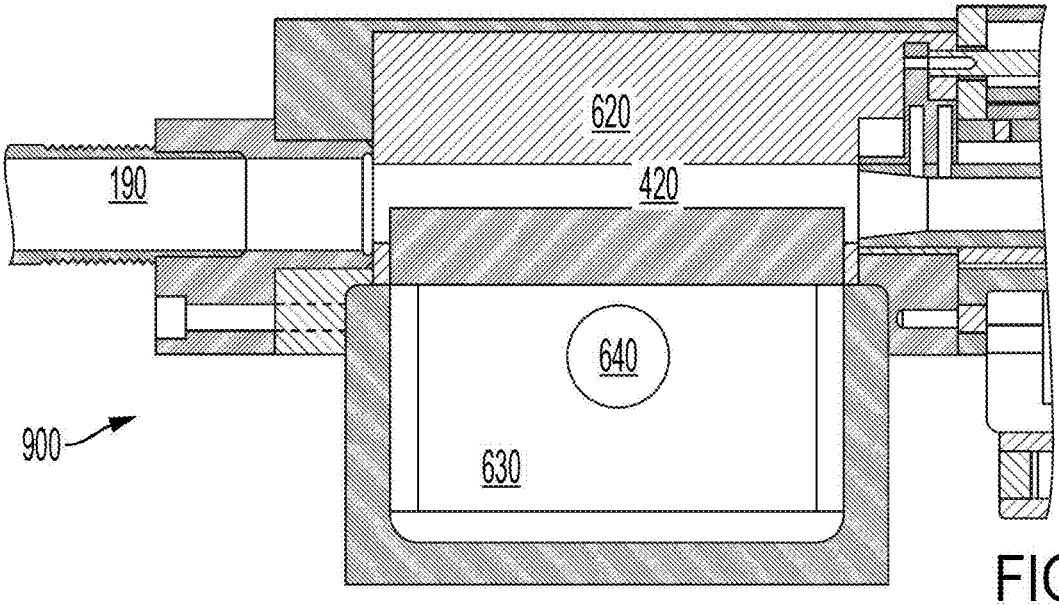
Figure 9C:
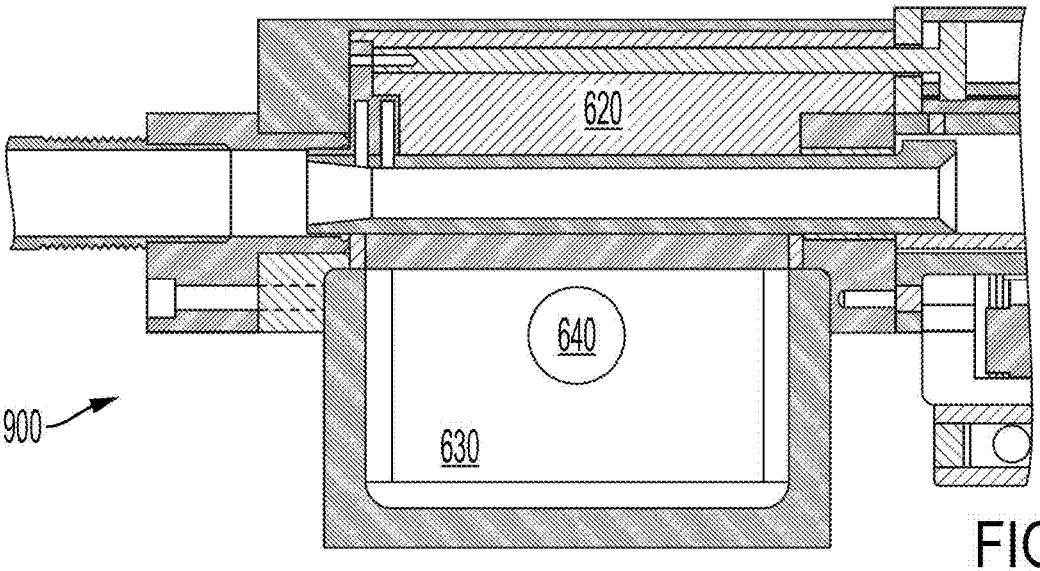

FIGS. 9A, 9B and 9C show detail cross-section elevation views of the sUDS rifle assembly 610 in the second configuration for liquid ammunition in the liquid ammunition magazine 630. The refill port 640 enables addition of liquid ammunition to replace that previously expended from the magazine 630.

There is a range of liquid ammunition that can be used, including non-Newtonian fluids, such as corn starch+cotton fibers+water. This mixture appears to maintain shape adequately, even when fired at high speed. The volume 630 is sized to accommodate ammunition. The chamber 420 pushes all the fluid in volume 630 upwards and immediately the bolt 350 drives this slug forward, pushing the fluid into the barrel 190. Then the air reservoir 245 releases high pressure gas to drive the round 370 out of the barrel 190. The liquid ammunition requires an additional solenoid 810 that drives the chamber 420 upwards, but the entire firing sequence is the same as for solid projectiles 370.

Exemplary embodiments provide a launcher device from which to shoot liquid or solid projectiles at a high speed using gas pressure. Gas pressure encompasses both compressed gas reservoirs and chemically generated initiators. A "liquid projectile" refers to a discrete mass of fluid from the magazine 620, unlike a fire hose, which shoots an uninterrupted jet of water. Discrete slugs of fluid are less susceptible to in-flight disintegration than a continuous stream.

Figure 10A:
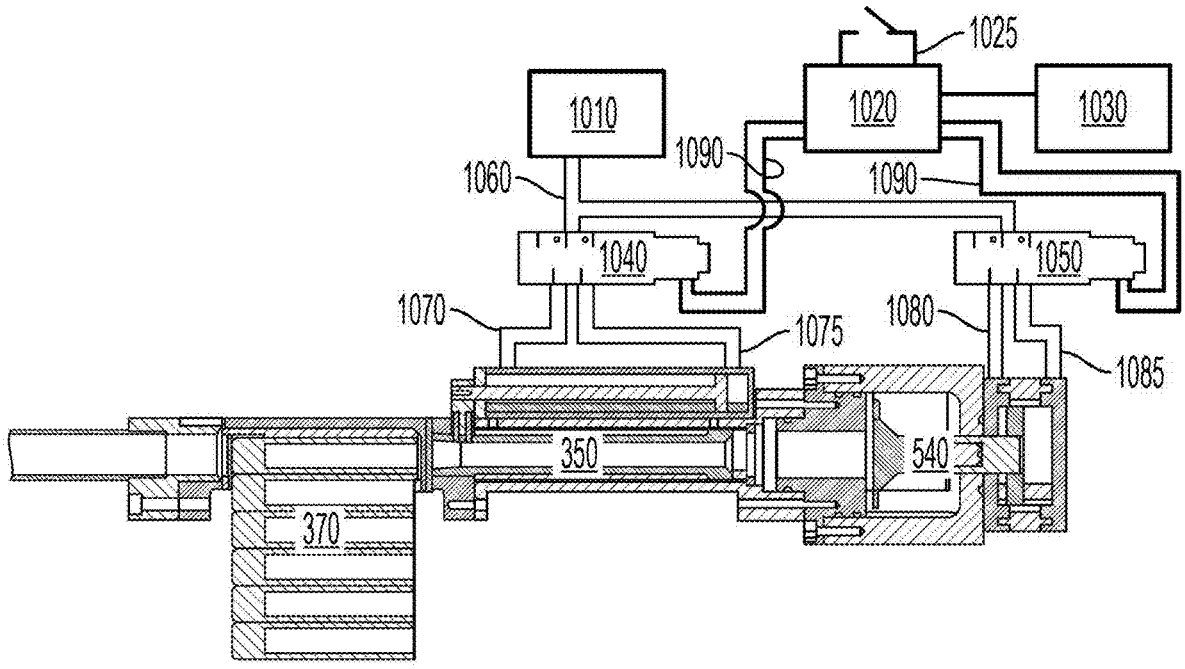
FIGS. 10A, 10B and 10C are detail cross-sectional elevation views of the second embodiment featuring the firing mechanisms.
Figure 10B:
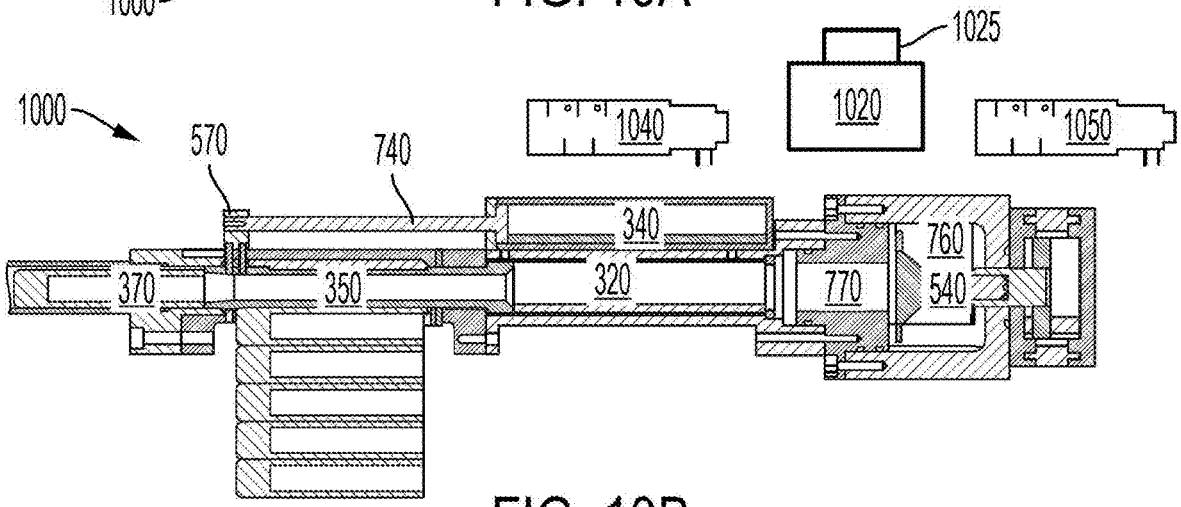
Figure 10C:
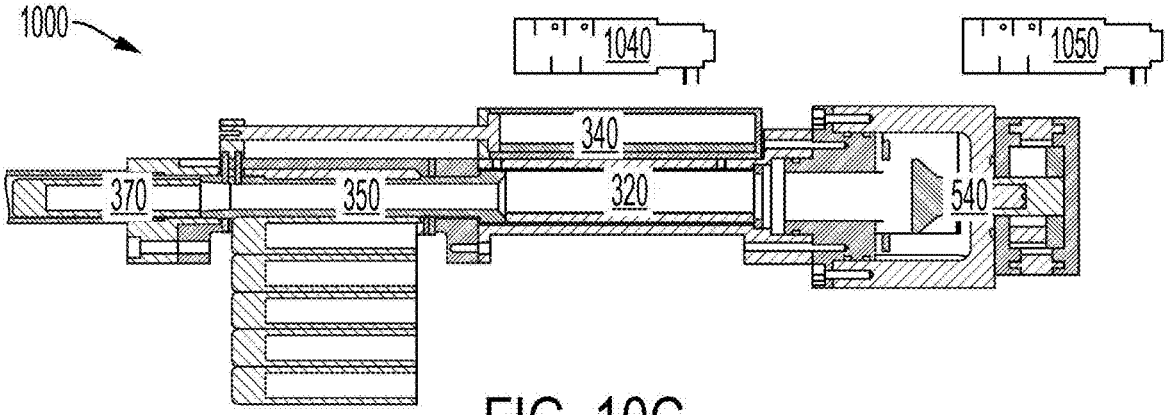

FIGS. 10A, 10B and 10C show detail cross-section elevation views 1000 of the loaded sUDS rifle 230 featuring the firing operation. A gas source 1010 supplies high pressure gas at between 690 kPa to 2.1 MPa. A firing circuit 1020 with a switch 1025 receives electrical power from a power supply 1030. The switch 1025 is shown as open and closes in response to pushing the trigger 650. The source 1010 connects to input ports of a pair of solenoid-manifolds 1040 that supplies the air loader 340 and manifold 1050 that refills the container 240 via conduits 1060.

The first manifold 1040 connects respective fore and aft conduits 1070 and 1075 to the air loader 340. The second manifold 1050 includes 1080 and 1085 to the container 240. The circuit 1020 connects fore and aft conduits to the manifolds 1040 and 1050 via electrical leads 1090. Upon closure of the switch 1025, the circuit 1020 energizes the manifolds 1040 and 1050.

FIG. 10A illustrates the rifle 110 in the initial position with the switch 1025 open and a round 370 from the magazine 120 in the chamber 420. The fore conduit 1070 and aft conduit 1085 contain high pressure gas, while the aft conduit 1075 and fore conduit 1080 are dormant. Note that the source 1010 and power supply 1030 are omitted from the remaining views to reduce clutter.

FIG. 10B illustrates the rifle 110 in the load position with the switch 1025 closed in response to the trigger 650. The first manifold 1040 exchanges fore and aft conduits 1070 and 1075 so the former becomes dormant and the latter fills with high pressure gas. Consequently, the tab 570 pulls the rod 740 and the bolt 350 forward from the loader 340 and the carrier 320, respectively, thereby pushing the round 370 into the barrel 190. The circuit 1020 with the switch 1025 open is omitted from the remaining views to reduce clutter.

FIG. 10C illustrates the rifle 110 in the firing mode, in which the second manifold 1050 exchanges fore and aft conduits 1080 and 1085 so the former fills with high pressure gas while the latter becomes dormant. Consequently, the plug 540 retracts from the ring 550 to pneumatically connect the volume 760 of the reservoir 245 with the gap 770. Meantime, the switch 1025 reopens. Following this operation, the rifle 110 returns to reload and recharge mode. This returns the mechanisms to the positions in the initial mode of FIG. 10A, including the conduits 1070, 1075, 1080 and 1085, with another round 370 pushed into the chamber 420.

When the plug 540 retracts, a direct pathway for all the high pressure gasses stored in volume 760 enables immediate discharge, and these gasses flow past the gap 770 and through the bolt 350. Then, high pressure gas directly acts on the aft side of the round 370, driving the round 370 out of the barrel 190.

The trigger 650 closes an electrical switch 1025, which signals the solenoid-manifold 1050 to shift high pressure air from fore air conduit 1070, which restrains the bolt 350, permitting rounds 370 to ingress to aft air conduit 1075, which pushes the bolt 350 forward and thereby presses a round 370 forward to be fired. The default position of the bolt 350 is aft. The manifold 1050 converts the trigger pull into switching on which port 1070 or 1075 that high pressure gas is applied, which controls whether the air loader 340 is aft or forward. When the bolt 350 slides forward, the manifold 1050 automatically commands the manifold 510 to pull aft (i.e., backward), which then releases all of the high pressure gas in reservoir 245 all the way through the bolt 350, and pushes the round 370 out of the barrel 190.

The default position for this air cylinder 750 is forward, which prevents high pressure gas from escaping the reservoir 245. Upon pulling the trigger 650, first the manifold 1050 tied to the air cylinder 750 fires, with the round 370 pushed into the barrel 190 while the air cylinder 750 remains forward, and second the manifold 1050 tied to the manifold 510 fires, with high pressure gas driving the round 370 out of the barrel 190, thereby "firing" the rifle 110, 230. Then both solenoid 810 and manifold 1050 return to their default positions. The air loader 340 slides backwards and the manifold 510 slides forward, enabling the rifle 110, 230 to reload.

Most rifle configurations shoot only one type of ammunition: solid projectiles or slugs of liquid consistency. A traditional powder driven cartridge, a Nerf blaster, and a tranquilizer dart gun are good examples that span the gamut of devices that launch a solid body using pressurized gas. A toy water gun provides an example of the liquid ejectors. By contrast design of the exemplary rifle enables an operator to shoot either liquid or solid projectiles from a single device.

Examples of traditional designs include the following. Traditional rifle/sidearm designs are composed of several items: a solid bullet, a cartridge case, a reactive powder, and a primer. The solid bullet, reactive powder, and primer and all located in the cartridge case. Upon mechanical action, a primer is initiated that in turn ignites the reactive powder. High-pressure gases are produced that drive the solid bullet down a barrel at a high speed; no external driving forces are required.

For example, paintball guns shoot a small solid round using compressed gas and a valve: when the valve opens a small charge of air rapidly expands and drive the paintball round out of the barrel; an external source of compressed gas is required. Water pistols use compressed air to drive a jet of water out of a reservoir using a similar method. However, no weapon design has been found that can shoot both solid and liquid rounds.

A rifle that can only shoot solid or liquid rounds limits the operator's ability to scale with a threat. For example, for police to engage riot control, they must selct between either (a) a large vehicle capable of supporting a continuous jet of water (requiring tremendous infrastructure to be transported) or (b) traditional non-lethal means of crowd control (e.g., bean bags, foam rounds). An individual operator cannot switch between round types.

In some cases, option (a) will not be operable, and the crowd will overpower the vehicle. On the other hand, traditional non-lethal rounds tend to cause severe injuries. Exemplary embodiments provide law enforcement an opportunity to escalate the intensity of their crowd control weapon as required, and minimizes the likelihood of applying an over- or under-application of force.

The exemplary sUDS rifle 110, 210 is an open-bolt design. The firing process proceeds as follows:

(1) The round, whether solid 370 or liquid (such as a slurry from corn starch, cotton fiber and water) is pushed into the chamber 420 in FIG. 9A.

(2) The operator depresses the trigger 650.

(3) Immediately after, an electrical signal initiated by the trigger 650 is sent to a gas solenoid 810, which pushes the bolt 350 forward. The bolt 350 remains in the forward position.

(4) As a result of step (3), the bolt 350 slides forward pushes the round 370 into barrel in FIG. 7B.

(5) Immediately after the bolt 350 is in the forward position, a signal *such as from the trigger 650, a delay circuit or a microcontroller) initiated by the trigger 650 is sent to a gas solenoid 810, which causes the annular sleeve 520 to retract its sealing surface as ring 550 in FIG. 7C.

(6) After the sealing surface as ring 550 retracts, high-pressure gases in the reservoir 760 in the sleeve 520 rush into the empty volume, and through the hollow bore of the bolt 350.

(7) The gas pressure builds in the empty volume in the chamber 420 behind the bolt 350, and begins to drive the round 370 down the barrel 190.

(8) The round 270 leaves the barrel 190, as propelled by the compressed gasses from container 240.

(9) The solenoid valve 810 receives an electrical signal to close the sealing surface as ring 550. The reservoir 245 connects to a high-pressure gas container 240, and upon its closure, the reservoir 245 refills with high-pressure gas.

from the container 240. The solenoid valve 810 receives an electrical signal to retract the bolt 350.

(11) As the bolt 350 retracts, the next round 270 is pushed into the chamber 420.

(12) The rifle 110 is ready to fire again.

The simplest design features the trigger 650 and solenoid 810 as an electric circuit, which is open by default until the trigger 650 is depressed as switch 1025. Meanwhile, the signal also activates a delay circuit, which controls the more complicated designs that engage the trigger 650 and an electrical signal into a microcontroller for more precise timing.

The method of loading ammunition depends on what is fired:

(1) For solid rounds 370 in a removable magazine 120, the force exerted by a magazine spring (not shown) pushes a solid round 370 into the chamber 420.

(2) Liquid rounds do not exist in a coherent form outside the chamber 420. The fluid exists in the magazine 630, and a metered quantity is pumped or pushed into the chamber 420. Several methods exist to accomplish this. After loading, both round configurations operate exactly the same in the rifle 110, 230.

Pneumatic rifles (such as air guns) are not new. Toy guns that shoot non-lethal rounds (Nerf guns) are not new. However, the sUDS rifle 110, 230 is designed to shoot a variety of solid and liquid rounds at velocities at or exceeding 100 m/s, with projectiles that weigh up to and exceeding 20 grams.

In many ways, one can conceive of the sUDS rifle 110, 230 as a novel mechanism for a single individual to shoot large projectiles—having a variety of purposes—at a high velocity and large distance accurately. There are several variations on the rifle design in both the loading mechanisms, the projectile that is ejected, and the aesthetics of the design.

A rifle that can shoot both solid rounds and liquid rounds finds many applications. The most pressing issues are addressed herein. Counter small-UAS (c-sUAS) weapons are of considerable interest. Small UASs plague the battlespace, and no non-lethal kinetic or non-Electronic Warfare technique is available for dealing with the problem. For example, soldiers cannot shoot at a quadcopter in a city due to the collateral damage caused by the rifle rounds. Fire hoses are not very effective at long range. Exemplary embodiments solve the c-sUAS problem by permitting a single operator to engage these small UASs with great efficacy without collateral damage to material or personnel.

In the same vein, there is a huge issue right now with non-lethal weapons for crowd control. Given the contemporary political climate, police need a non-Lethal weapon system that is actually non-lethal. The proposed method can fulfill that need by shooting non-lethal rounds.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A hand-held long-gun for interchangeably propel a round, said gun comprising:

a gas actuator for storing and releasing compressed gas;

a firing module that includes a chamber for receiving said gas to push forward a bolt in response to actuation by a trigger, said module disposed forward of said actuator;

a magazine for containing ammunition that constitutes the round that constitutes one of a elongated axisymmetric solid and a volumetrically constrained liquid, wherein said magazine includes a fill port for receiving a liquid supply;

a loader for laterally receiving the round from said magazine and longitudinally receiving said bolt to eject the round, said loader disposed forward of said module; and a barrel for directing the round ejected from said loader, said barrel disposed forward of said loader.

2. The gun according to claim 1, wherein said gas actuator comprises a compressed air storage container and an air release reservoir.

3. The gun according to claim 2, wherein said compressed air storage container includes a manifold and an end flange.

4. The gun according to claim 2, wherein said air release reservoir includes a pressurized sleeve and a fore flange.

5. The gun according to claim 1, wherein said firing module comprises an upper portion and a lower portion.

6. The gun according to claim 1, wherein said magazine can one of attach and detach from said loader.

7. The gun according to claim 1, wherein said firing module further includes a solenoid to activate in response to said trigger to release said gas from said actuator for forcing said bolt forward.

8. The gun according to claim 1, further including a handle for housing said trigger and a butt stock for supporting said actuator.

* * * * *